United States Patent [19]

Lindahl et al.

[11] Patent Number: 4,551,989

[45] Date of Patent: Nov. 12, 1985

[54] OIL EQUALIZATION SYSTEM FOR REFRIGERATION COMPRESSORS

[75] Inventors: Herbert S. Lindahl, Danville, Ill.; Paul V. Barsteika, Covington, Ind.; Daniel P. Werner, Danville, Ill.

[73] Assignee: Gulf & Western Manufacturing Company, Southfield, Mich.

[21] Appl. No.: 676,919

[22] Filed: Nov. 30, 1984

[51] Int. Cl.[4] ..... F25B 43/02

[52] U.S. Cl. ..... 62/468; 62/510; 417/428; 418/97

[58] Field of Search ..... 62/84, 468, 510; 418/97; 417/427, 428

[56] References Cited

U.S. PATENT DOCUMENTS

| | | | |
|---|---|---|---|
| 3,360,958 | 1/1968 | Miner | 62/510 |
| 3,386,262 | 6/1968 | Hackbart et al. | 62/510 |
| 3,503,223 | 3/1970 | Parker | 62/510 |
| 3,580,006 | 5/1971 | Quick | 62/510 |
| 3,581,519 | 6/1971 | Garrett, Jr. | 62/468 |
| 3,621,670 | 11/1971 | Kinney | 62/468 |
| 3,633,377 | 1/1972 | Quick | 62/468 |
| 3,645,109 | 2/1972 | Quick | 62/510 |
| 3,719,057 | 3/1973 | Grant | 62/510 |
| 3,785,169 | 1/1974 | Gylland, Jr. | 62/468 |
| 3,905,202 | 9/1975 | Taft et al. | 62/510 |
| 4,053,725 | 10/1977 | Kramer | 62/468 |
| 4,102,149 | 7/1978 | Conley | 62/468 |
| 4,179,248 | 12/1979 | Shaw | 62/510 |
| 4,383,802 | 5/1983 | Gianni et al. | 62/510 |
| 4,411,141 | 10/1983 | Hara | 62/468 |

*Primary Examiner*—Ronald C. Capossela
*Attorney, Agent, or Firm*—William J. Spatz

[57] ABSTRACT

A lubricant distribution system for refrigeration units having a plurality of parallel compressors which system maintains the proper level of lubricant in the compressors during operation. The system comprises compressor suction inlet lines which connect each of the compressors of the system with a common suction header located at an elevation below the suction inlets on the compressors. The common suction header is connected to the evaporator outlet by a conduit which extends from the evaporator to the common suction header. The compressors suction inlet lines are sized to provide a suction gas mass velocity therethrough which is sufficient to carry lubricant into the compressors as an entrained liquid even when the compressors are operating at partial capacity.

9 Claims, 2 Drawing Figures

OIL EQUALIZATION SYSTEM FOR REFRIGERATION COMPRESSORS

BACKGROUND OF THE INVENTION

This invention relates to refrigeration systems employing multiple compressors in parallel and particularly to a system for achieving the proper level of lubricant in each of the compressors of such a system when all of the compressors are operating and also when one or more of the compressors are out of operation or operating at partial capacity.

During operation of refrigeration compressor systems, it is common for compressor lubricant to be carried from the compressors by the compressed refrigerant, so that, unless it is separated at some point, the lubricant circulates with the refrigerant throughout the system. Where a refrigeration system employs multiple compressors in parallel, it is important that the appropriate amount of lubricant be returned to each of the compressors in order that each compressor has at all times a supply sufficient for its lubrication needs, but not so much lubricant as to impair its operation.

There is a recognized tendency in multiple parallel refrigeration compressor systems for lubricant to excessively accumulate within one or more of the compressors of the system at the expense of the other compressors in the system. In an effort to overcome this tendency, a variety of systems have been employed to maintain the correct level of lubricant in all of the compressors of a parallel system. Such systems are particularly important where it is intended that a parallel compressor system will be operated with less than all of its compressors or with some compressors at less than full capacity, for it is common to have lubricant accumulate in non-operating and partial capacity compressors.

One solution to the afore-referenced problem of lubricant accumulating in certain compressors of a parallel compressor system has been to mount a lubricant separator on the discharge side of the compressors to separate the lubricant from the discharge gas and return it to the compressor. The use of lubricant separators on the compressor discharge has, however, been accompanied by undesirable side effects, such as increased crankcase temperature caused by the elevated temperature of the lubricant in the compressor discharge gas. Further, as there is a tendency for parallel compressors to operate at slightly different pressures, there is a concommitant tendency for lubricant from the separator to be directed preferentially to the compressor having the lowest pressure which, of course, results in low lubricant levels developing in the other compressors of the system. To compensate for these deficiencies, complex and expensive controls have often been provided in such systems; aside from their cost, such controls are considered to be undesirable as they are prone to failure.

Other attempts to solve the problem of uneven lubricant distribution in parallel compressor systems are described in U.S. Pat. Nos. 4,179,248 and 4,411,141. These systems also utilize intricate valves and controls to regulate the level of lubricant in the compressor and are expensive and prone to failure.

Accordingly, it is an object of the present invention to provide an improved lubricant return system for parallel refrigeration compressors.

Another object of the present invention is to provide an improved lubricant return system which avoids complicated and intricate controls to regulate the level of lubricant in parallel refrigeration compressors.

Another object of the present invention is to provide an improved lubricant return system for parallel refrigeration compressors which avoids excessive buildup of lubricant in compressors of the system which are not operating or which are operating at partial capacity.

SUMMARY OF THE INVENTION

In accordance with the present invention, a multiple parallel compressor-type refrigeration system is provided with a suction gas distribution system which apportions lubricant between the compressors of the system in a fashion which maintains the appropriate level of lubricant for operation in each of the compressors. With the suction gas distribution system of the present invention, the desired level of lubricant can be maintained in the compressors of a refrigeration system without resort to any of the devices previously employed for that purpose, such as lubricant equalizing lines between the crankcases of the compressors, separators on the compressor discharges to remove entrained lubricant from the compressor discharge gas, and/or valving and controls to regulate the flow of lubricant between the compressor crankcases or between lubricant separators and the compressors. The foregoing advantages are obtained by utilizing a novel arrangement and design of the compressor's suction inlet piping.

The piping arrangement of the present invention calls for the placement of a common suction header for the parallel compressors at a level which is below the suction inlets for each of the compressors and for the compressors to be connected to the common suction header with branch lines which extend upwardly from the suction header. The compressor suction inlets should be at an elevation above the maximum operating level for lubricant in the compressor crankcase. The branch suction lines of the system are sized to provide a refrigerant mass velocity, which is sufficiently high to carry lubricant from the common suction header to the compressor suction inlet as an entrained liquid, even at the lowest flow rate condition postulated for a compressor. To insure appropriate distribution of lubricant among the compressors of the described system, it is a further teaching of this invention that branch lines extending from the common suction header should do so in a symmetrical fashion and with the length of the branch lines being substantially equal. Further, it is preferred that the flow paths to each of the compressors in a system employing the present invention should be able to be drawn from the evaporator discharge without passing the branch connection for any other compressor. Symmetrical suction line branching of the type described is readily accomplished for two compressor systems when a T connection is used to split the flow from the evaporator discharge line to the branch lines connected to the compressor suction inlets. Three or more compressors may be piped according to the invention in pyramidal or yoke-type arrangements where the flow from the evaporator outlet is T-split as afore-described into a first suction header and then the flow from each end of the first suction header is again T-split to a second suction header with the lines to the second header from the first suction header being located on the second suction header between three branch lines which either extend to three parallel compressors in the fashion afore-described or to a third suction header which in turn is branched in a similar fashion for a greater number of compressors. It will be apparent to those skilled in the art of refrigeration piping that in the parlance of the above description, the pyramidal suction piping of X parallel compressors requires X-1 flow splitting suction headers.

Other objects, features and advantages of the invention will be apparent from the following detailed description taken in connection with the accompanying drawings.

BRIEF DESCRIPTION OF THE DRAWINGS

FIG. 1 is an elevational view only with regard to the relationship of the common suction header, compressor suction branch lines and the compressor.

FIG. 2 is an elevational view only with regard to the relationship of the common suction header, compressor suction branch lines and the compressor.

DETAILED DESCRIPTION OF THE INVENTION

Figure 1:
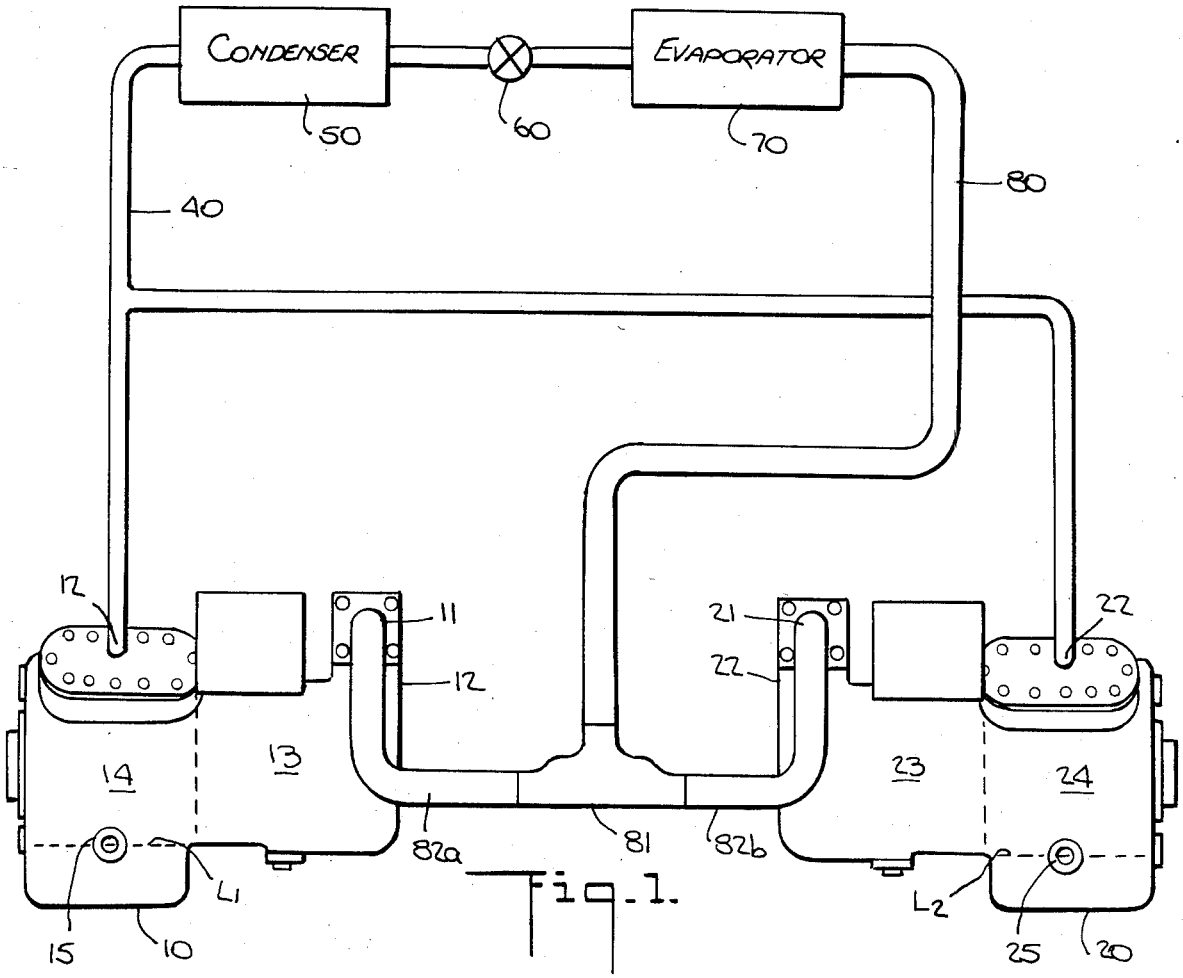
FIG. 1 is a partial schematic, partial elevational view of a two-compressor parallel refrigeration compressor system utilizing the lubricant return system of the present invention.

Referring to the drawings wherein like parts are designated by the same number in all the figures, there is shown in FIG. 1 a refrigeration system employing a pair of compressors operating in parallel to feed a condenser and evaporator. The refrigeration system employs the lubricant distribution and equalization scheme of the present invention and is shown as applied to a system utilizing a pair of reciprocating compressor units depicted generally as units 10 and 20. Compressors 10 and 20 are connected in parallel to discharge header 40 which in turn is connected to a condenser unit generally depicted at 50. Downstream of condenser 50 is refrigerant throttling means 60 and refrigerant evaporator 70. Refrigerant evaporator 70 feeds evaporator outlet line 80 which in turn extends to suction T 81, from which extends branch suction lines 82*a* and 82*b*. FIG. 1 is schematic with regard to the orientation and relative elevations of discharge header 40, condenser 50, throttling means 60, refrigerant evaporator 70 and outlet line 80: it should be recognized that these components of the system may be located either above or below the plane of the compressors 10 and 20.

The suction gas enters compressors 10 and 20 through compressor suction inlets 11 and 21 which are located at the top of their respective compressor casings. Compressed gas is discharged from compressors 10 and 20 at discharge ports 12 and 22 from whence the compressed gas flows through individual discharge lines to common discharge header 40. Lubricant separates from the suction gas in suction chambers at the ends of the compressor casings and accumulates in the bottom of motor chambers 13 and 14 from whence it passes into the lower portion of compressor crankcases 14 and 24, filling crankcases 14 and 24 with lubricant to a level appropriate for the particular compressor model utilized in the refrigeration system. The normal levels $L_1$ and $L_2$ of accumulated lubricant in crankcases 14 and 24 are at the elevation of sight glasses 15 and 25, which are always below the compressor suction inlets 11 and 21.

While compressors 10 and 20 are depicted in the figure as reciprocating compressors, they may be any other type of compressor which is suitable for use in refrigeration systems.

In the preferred embodiment of the invention, evaporator outlet line 80 extends from evaporator 70 in a downward run to suction T 81 which is located at an elevation below compressor suction inlets 11 and 21. Branch suction lines 82*a* and 82*b* extend from suction T 81 to compressor suction inlets 11 and 21. Branch suction lines 82*a* and 82*b* are approximately equal in length and are each sized so as to provide for a gas velocity therethrough which is sufficient for lubricant entrainment at the lowest flow rate conditions under which compressors 10 and 20 can operate. Further, suction T 81 is located at an elevation relative to suction inlets 11 and 21 such that, at the design gas velocity, lubricant will stay entrained in the suction gas over the vertical run provided therebetween. The method for calculating the appropriate lines sizes to achieve lubricant entrainment in the suction gas at design gas flow rates will be familiar to those skilled in the refrigeration art or knowledgeable of the ASHRAE guidelines.

In operation, compressors 10 and 20 pass high-pressure, high-temperature vapor refrigerant with entrained lubricant through discharge ports 12 and 22, into and through the individual discharge lines connected thereto which then merge into discharge header 40. The high-temperature refrigerant vapor is cooled, condensed and collected in condenser 50. The liquified refrigerant is throttled across regulating valve 60 into evaporator 70 where it absorbs heat from the environment to be refrigerated and rises in temperature to a pre-determined level of superheat.

From evaporator 70, the hot vapor refrigerant, carrying with it the lubricant which was entrained in the compressor discharge gas, flows through evaporator outlet line 80 until it reaches suction T 81. At suction T 81, the hot refrigerant from evaporator 70 is split into two separate streams which are directed one to compressor 10 and the other to compressor 20. In the depicted preferred embodiment of the invention, suction T 81 and the aligned horizontal sections of branch suction lines 82*a* and 82*b* comprises a substantially horizontal common suction header.

In keeping with the present invention, when either compressor 10 or 20 is shut down for repair, or because of reduced refrigeration load, the appropriate amount of lubricant is directed to the operating compressor and does not drain into and flood the non-operating compressor, as is commonplace with many of the prior art systems. It is also a feature of the present invention that when either or both compressors 10 or 20 are operated at less than full capacity, the appropriate amount of lubricant to maintain proper operating levels is nonetheless distributed to the compressors, notwithstanding their partial operating capacity.

Figure 2:
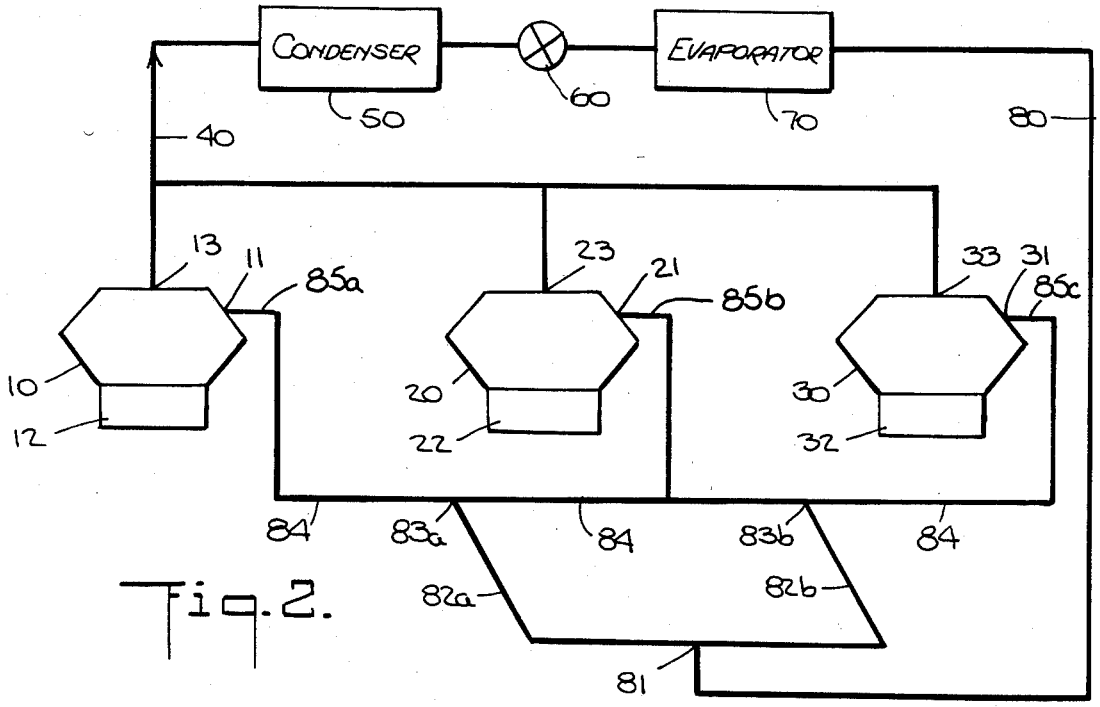
FIG. 2 is a schematic, partial elevational view of a three compressor parallel refrigeration compressor system utilizing the lubricant return system of the present invention.

Shown in FIG. 2 is a multiple parallel compressor-type refrigeration system employing three compressors in parallel. The compressors of the system, numbered 10, 20 and 30 in the figure, are shown in schematic form as are the condenser 50, throttling means 60 and evaporator 70. Just as is in the case of the two-compressor system aforedescribed, compressors 10, 20 and 30 are connected in parallel to discharge header 40, which is in turn connected in series to condenser unit 50, refrigerant throttling means 60, and refrigerant evaporator 70. Superheated refrigerant vapor from evaporator 70 flows into evaporator outlet line 80 which in turn feeds a pyramidal distribution system. Specifically, the superheated refrigerant vapor in evaporator outlet line 80 flows into suction T 81 which splits the superheated refrigerant between branch suction lines 82*a* and 82*b*. Branch suction lines 82*a* and 82*b* terminate respectively in a common suction header 84 with, respectively, T's 83*a* and 83*b*. In the preferred embodiment of the invention, suction header 84 is substantially horizontal. T's 83*a* and 83*b* are positioned on common suction header 84 at points which are preferably midway between the connection points of branch suction lines 85*a*, 85*b* and 85*c*, which carry the superheated refrigerant vapor to the compressor suction inlets which are depicted in the drawing as respectively 11, 21 and 31. Suction header 84 is located at an elevation below compressor suction inlets 11, 21 and 31 and branch suction lines 85*a*, 85*b* and 85*c* are preferably of approximately equal length. The branch suction lines are each sized so as to provide for a gas velocity therethrough which is above the minimums specified in connection with the two-compressor system aforedescribed.

In operation, the lubricant return system, according to the present invention depicted in FIG. 2, serves to distribute entrained lubricant between the operating compressors of the system in the same fashion aforedescribed with regard to the two-compressor system depicted in FIG. 1. Accordingly, as superheated suction gas is drawn from suction header 84, according to the requirements of the operating compressors, it will carry with it as an entrained liquid the appropriate amount of lubricant for the maintenance of the proper lubricant level in the manifolds 12, 22 and 32. In accordance with the present invention, should one or more of the compressors of the three-compressor system be operated at less than full capacity, use of the system of the present invention will insure that those compressors receive a lesser, but nonetheless adequate, portion of the available lubricant. In a similar fashion, should one or more of the compressors be shut down for repair or for reduced demand, the system also serves to insure that the lubricant is directed to the operating compressors in the proper amount.

It will be recognized by those skilled in the art that it is possible to employ the pyramidal or yoke-type suction piping arrangement utilized in the three-compressor system of FIG. 2 to accommodate compressor systems with four or more compressors.

It should be recognized that the lubricant return system described herein does not require the use of complicated valving or pumps to maintain the appropriate distribution of lubricant between the compressors of a multiple parallel compressor refrigeration system. Rather, the lubricant return scheme described in simple, inherently reliable and low in cost.

What is claimed is:

1. In a refrigeration system having a plurality of parallel compressors drawing refrigerant vapor from an evaporator and not having a lubricant separator upstream of said evaporator, an improved lubricant return system for distributing the proper amount of lubricant to each compressor to maintain the proper crankcase level of lubricant for operation comprising:

a compressor suction inlet on each compressor located at an elevation above the maximum crankcase lubricant level, a common suction header located at an elevation below that of the compressor suction inlet on each of the compressors, said common suction header being connected by a conduit to the outlet of said evaporator, and compressor suction branch lines connecting the compressor suction inlets with the common suction header, each said branch line being of a size that, at the minimum operating capacity of the compressor serviced thereby, the mass velocity of the suction gas to the compressor is sufficent to carry lubricant into the compressor as an entrained liquid.

2. The improved parallel refrigeration compressor lubricant distribution system of claim 1 wherein the refrigeration system has two parallel compressors and wherein said common suction header is connected to the conduit from the evaporator outlet with a T fitting on said common suction header between the compressor suction branch lines.

3. The improved parallel refrigeration compressor lubricant distribution system of claim 2 wherein said common suction header is substantially horizontal.

4. The improved parallel refrigeration compressor lubricant distribution system of claim 2 wherein the compressor suction branch lines are of substantially equal length.

5. The improved parallel refrigeration compressor lubricant distribution system of claim 1 wherein the refrigeration system has three parallel compressors and wherein said common suction header is connected to the evaporator oulet with a pyramidal flow splitting piping arrangement.

6. The improved parallel refrigeration compressor lubricant distribution system of claim 5 wherein the pyramidal flow splitting piping arrangement comprises a means for splitting refrigerant flow from the evaporator oulet conduit into a left branch and a right branch of a primary suction header, a means for connecting of said left branch of said primary suction header into said common suction header between the compressor suction branch lines for a first and second compressors of said refrigeration system and a means for connecting of said right branch of said primary suction header into said common suction header between the compressor suction branch lines for said second compressor and the third compressor of said refrigeration system.

7. The improved parallel refrigeration compressor lubricant distribution system of claim 6 wherein the means for splitting the refrigerant flow from the evaporator outlet conduit into said left and right branches of said primary suction header, and the means for connecting said left and right branches of said primary suction header into said common suction header each comprise T fittings.

8. The improved parallel refrigeration compressor lubricant distribution system of claim 7 wherein the compressor suction branch lines are of substantially equal length.

9. The improved parallel refrigeration compressor lubricant distribution system of claim 6 wherein said common suction header is substantially horizontal.

* * * * *